US005678697A

United States Patent [19]

Fuchs et al.

[11] Patent Number: 5,678,697

[45] Date of Patent: Oct. 21, 1997

[54] SORTING INSTALLATION

[75] Inventors: Dieter Fuchs, Waldburg; Wolfgang Stehle, Schlier, both of Germany

[73] Assignee: Maschinenfabrik Bezner GmbH & Co. KG, Ravensburg, Germany

[21] Appl. No.: 362,522

[22] PCT Filed: May 10, 1994

[86] PCT No.: PCT/DE94/00558

§ 371 Date: Jan. 5, 1995

§ 102(e) Date: Jan. 5, 1995

[87] PCT Pub. No.: WO94/26429

PCT Pub. Date: Nov. 24, 1994

[30] Foreign Application Priority Data

May 11, 1993 [DE] Germany ..... 43 15 691.6
May 10, 1994 [DE] Germany ..... 44 16 457.2

[51] Int. Cl.[6] ..... B07C 7/04

[52] U.S. Cl. ..... 209/705; 209/930

[58] Field of Search ..... 209/3.1, 702, 705, 209/930

[56] References Cited

U.S. PATENT DOCUMENTS

| | | | |
|---|---|---|---|
| 2,257,567 | 9/1941 | Matanovich-Manov et al. | 209/930 X |
| 3,595,389 | 7/1971 | Morgan et al. . | |
| 4,013,551 | 3/1977 | de Feudis . | |
| 4,113,610 | 9/1978 | Mueller | 209/705 |
| 4,465,195 | 8/1984 | Buer et al. . | |
| 4,760,925 | 8/1988 | Stehle et al. . | |
| 5,100,537 | 3/1992 | Krause . | |
| 5,116,486 | 5/1992 | Pederson | 209/702 X |
| 5,249,690 | 10/1993 | Patterson | 209/705 X |
| 5,344,025 | 9/1994 | Tyler et al. | 209/930 X |

FOREIGN PATENT DOCUMENTS

| | | | |
|---|---|---|---|
| 0123825 | 11/1984 | European Pat. Off. . | |
| 0439701 | 8/1991 | European Pat. Off. | 209/930 |
| 182993 | 8/1904 | Germany . | |
| 2501803 | 10/1986 | Germany . | |
| 9100359 | 9/1992 | Netherlands . | |
| 2109762 | 6/1983 | United Kingdom . | |
| 85/03890 | 9/1985 | WIPO . | |

*Primary Examiner*—Karen B. Merritt
*Assistant Examiner*—Scott L. Lowe
*Attorney, Agent, or Firm*—Spencer & Frank

[57] ABSTRACT

A sorting installation for useful products is proposed, which serves in particular to sort out reusable packaging materials. In order to achieve the sorting-out of individual types of packaging with maximum efficiency, the sorting-out of individual monofractions is undertaken, on one or more manual sorting sections, onto a collector conveyor belt which is connected in parallel, the content of which, after sorting-out is complete, is introduced into an associated bunker.

15 Claims, 9 Drawing Sheets

SORTING INSTALLATION

BACKGROUND OF THE INVENTION

The invention relates to a sorting installation.

A sorting installation for sorting useful products from dry refuse such as paper, glass, cardboard, plastics or the like has been disclosed in U.S. Pat. No. 3,595,389. In this installation, the mixture of useful products to be sorted is passed via conveying devices to a manual selection belt, where manual sorting workplaces having drop shafts are provided. At these workplaces, the useful products to be sorted are taken manually by the employees from the manual selection belt and placed in drop shafts arranged to the side of the operative. The drop shafts assigned to a particular useful product fraction then lead to the useful product bunkers situated below, from which the useful products can be disposed of as an individual fraction.

The device according to the U.S. Pat. No. 3,595,387 makes provision for different drop shafts to be assigned, in each case, to the operatives standing by the manual selection belt so that the operatives are each required to concentrate only on certain useful products. In general, however, it is envisaged that each operative will be required to sort out a large number of individual useful products from the manual selection station.

This type of sorting of useful products has the disadvantage that, firstly, a large number of drop shafts has to be present in each operative's section in order to dispose of the large number of useful products arising, such as paper, glass, metal, material, board, plastics, etc. This results in a high space requirement and a high mechanical effort, since the drop shafts have to be guided to corresponding bunkers with complex guide devices.

Furthermore, the sorting of a large number of useful products creates difficulties for the operative insofar as a constant process of thought is necessary in order to assign each useful product picked up by hand to a particular drop shaft.

In addition, the arrangement of the drop shafts can in some cases be disadvantageous, that is to say ergonomically unsatisfactory, since each operative has to service a plurality of drop shafts.

A remedy for this can be provided by a sorting system in which each operative sorts out only a single useful product fraction from a useful product mixture and passes this to a nearby drop shaft. Such a treatment, is, however, somewhat impracticable with a running manual selection conveyor belt, since the useful product mixture passes the operative too rapidly.

A further sorting device has been disclosed by EP-0 123 825 A2. In this sorting installation, the useful products to be sorted out are guided on a circular conveying path, beside which are arranged both manual and automatic sorting workplaces with drop shafts. With such a system, the material to be sorted can be kept in a cycle until the individual useful product fractions are sorted out. With this installation, also, the various useful products are passed by an operative into various drop shafts.

The core concept of the sorting-out of useful products is the reuse of the raw materials contained in valuable packaging material. For this purpose, the "Dual System" was established in Germany, guaranteeing that industry would take back packaging materials of all types. For this purpose, the packaging which are intended to be passed to a recycling process for reuse are provided with the so-called "Green Dot". This relates to packagings of all types such as glass, tinplate, aluminum, board/cardboard, paper, plastics and laminates. The objective is to collect on a large scale these packaging materials which are produced, to sort them and to return the recovered individual fractions to a recycling process. The problem arising here is that, in the future, huge quantities of packaging material will be produced in an unsorted state and will have to be treated accordingly.

SUMMARY OF THE INVENTION

The object of the invention is to optimize the known sorting installations with a view to being able to achieve a higher throughput. This applies in particular to manual sorting workplaces.

This object is achieved, starting from a sorting installation of the type described initially, by providing at least one sorting section for supplying a variety of useful products for sorting therefrom a plurality of specific useful product monofractions. A plurality of useful product bins are provided, each being designated to receive a specific useful product monofraction from the variety of useful products. At least one collection device is positioned parallel to the sorting section for receiving the specific useful product monofraction and conveying the specific useful product monofraction from the sorting section to a designated useful product bin. The collection device is still during a first operating cycle so that the specific useful product monofraction can be received by the collection device, and is operatable during a second, successive operating cycle in which the collection device empties the specific useful product monofraction thereon into the designated useful product bin. The first and second operating cycles are repeatable for sorting at least an additional different specific useful product monofraction from the variety of useful products. The core concept on which the invention is based is that the effectiveness of manual sorting-out is much greater if the operative standing at the sorting workplace sorts out, in each case, only one particular useful product fraction. It is expedient here if a large number of operatives stand by a particular stretch of a manual selection belt, all of them simultaneously removing a particular useful product fraction from the sorting belt which is, if possible, stationary and passing it to a nearby collection device. The collection device must then be switched so that, during this working interval or working cycle, the collected useful product fraction is passed to a collection bunker which is entirely specific to that fraction. When a particular useful product fraction is sorted out from the sorting belt or manual selection belt within this working cycle, then, in a subsequent working cycle, another useful product fraction, again over a particular period for all operatives simultaneously, is passed to the collection device and from there, in turn, to another particular useful product bunker.

In this manner, the consecutive sorting-out of the individual useful products from the manual selection belt can be carried out at very high speed and with very high effectiveness, the collection device being required to receive only one particular useful product fraction in each working cycle and passing this continuously or intermittently to a particular useful product bunker.

From this useful product bunker, the sorted-out fractions are then each brought to a conveyor device from where they are passed, for example, to a baling press.

The collection device assigned to the sorting belt or manual selection belt in order to receive a particular useful product fraction in a particular working cycle can be of widely varied design. In the simplest form, this collection device can be, for example, a conveyor belt connected in parallel to the manual selection belt and serving as an interim store. This interim store is then charged, in the respective working cycle, with a particular useful product fraction. In this arrangement the working cycle is generally designed to last until the particular useful product fraction has been very largely sorted off the manual selection belt. Thereafter, this interim store, for example designed as a conveyor belt, is emptied by the passing of the material to an associated bunker. This can expediently be achieved in that a conveyor belt which can be driven in both directions is located above a large number of bunkers, arranged side by side, and the conveyor belt is arranged to be longitudinally displaceable in both longitudinal directions, in a manner such that one of the two dropping ends is located above the associated useful product bunker.

It has proven very expedient if an additional preliminary storage device is assigned to the collection device, and especially to the collector belt, to receive a certain useful product fraction from the operative, on which preliminary storage device the useful product fraction which has been sorted out is initially placed.

This charging of the preliminary storage device takes place at least over a period such as is required by the actual collection device, that is to say the collector belt, in order to pass the useful product fraction resting on it to a particular useful product bunker.

During this period, the operating personnel can already, in a subsequent working cycle, introduce the new useful product fraction into the preliminary storage device, without any loss of time occurring. When the collection device has been emptied of a particular useful product fraction, the content of the preliminary storage device with the subsequent useful product fraction can be placed on the collector belt.

The preliminary storage device can be designed in a wide variety of ways. In general, the useful product fraction sorted out in each working cycle has to be received in an interim store in order to bridge the period of emptying of the collection device, that is to say of the collector conveyor belt. If no such time-lag exists because of the set-up of the system, it is possible wholly or largely to dispense with such a preliminary storage device.

For example, the collection device can also be designed as a pneumatic conveyor line to the individual useful product bunkers, in which case the flow conveyed to the associated useful product bunker must be regulated accordingly. In this case, the preliminary storage device can be designed, for example, as a bucket wheel or drum magazine, in order to feed a particular useful product fraction to the pneumatic conveyor line at a particular point in time.

If conventional collector conveyor belts are used as the collection device, the preliminary storage device can, for example, consist of a useful product collector channel, having a deflector flap, which releases the useful product fraction at a given time to be fed onto the collector belt.

It is also possible, for example, to provide two collector belts lying side by side which are assigned to a manual selection belt or sorting belt. By means of appropriate deflector flaps, one of these collector belts in each case is then charged with a particular useful product fraction, during which the other collector belt undertakes the operation of emptying into the associated useful product bunker.

The critical feature is the avoidance of intervals in which the operating personnel are no longer able to carry out the sorting operation because of the emptying operation of the collection device or of the collector belt. This has to be avoided with suitable preliminary storage devices, which receive the useful product fraction to be sorted out for at least sufficiently long for the collector belt to be freed again in order to receive a new useful product fraction.

The sorting installation according to the invention provides, in its basic embodiment, a sorting belt or a manual selection belt to which are assigned a collector belt as a collection device and useful product bunkers which, in turn, correspond to the latter. It is of course also possible for a plurality of sorting belts to be connected in parallel, each of them having associated collector belts. Various useful product mixtures can then be moved on the parallel sorting belts past the sorting workplaces, upstream sorting devices being responsible for preliminary separation of the packaging material or useful products delivered.

DETAILED DESCRIPTION OF THE INVENTION

Figure 1:
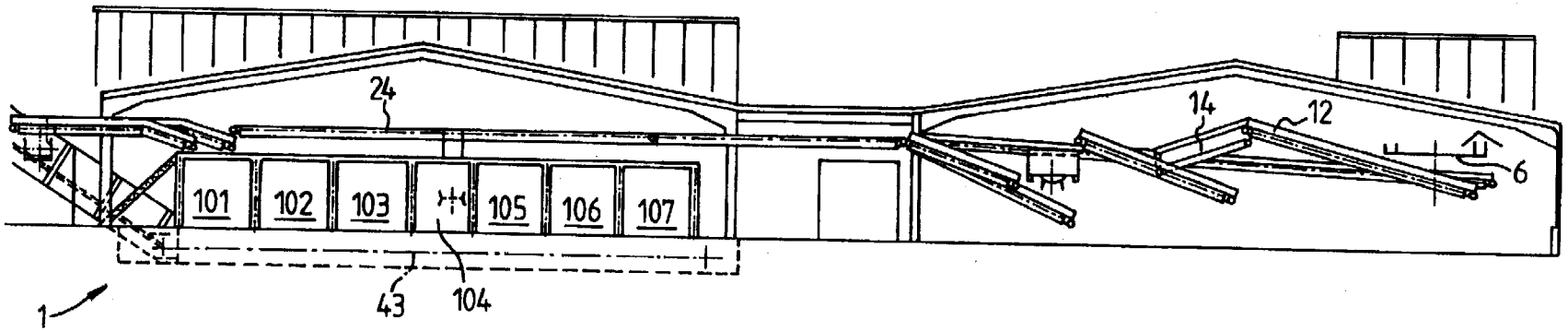

Further details of the invention are shown in the drawings. An illustrative embodiment of the invention is explained in detail, with reference to these drawings, in the description which follows, further advantages being indicated.

In the drawings:

FIG. 1 shows a lateral view and

Figure 2:
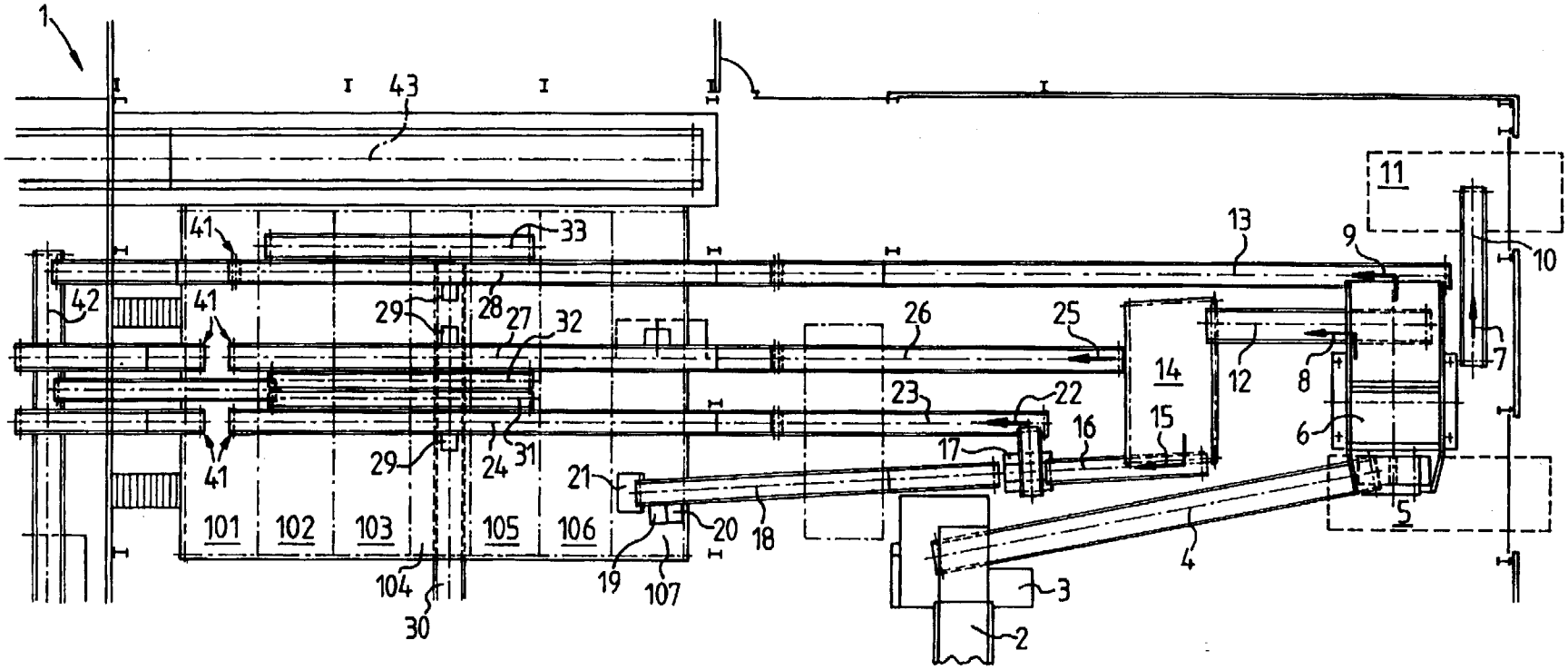
Figure 3A:
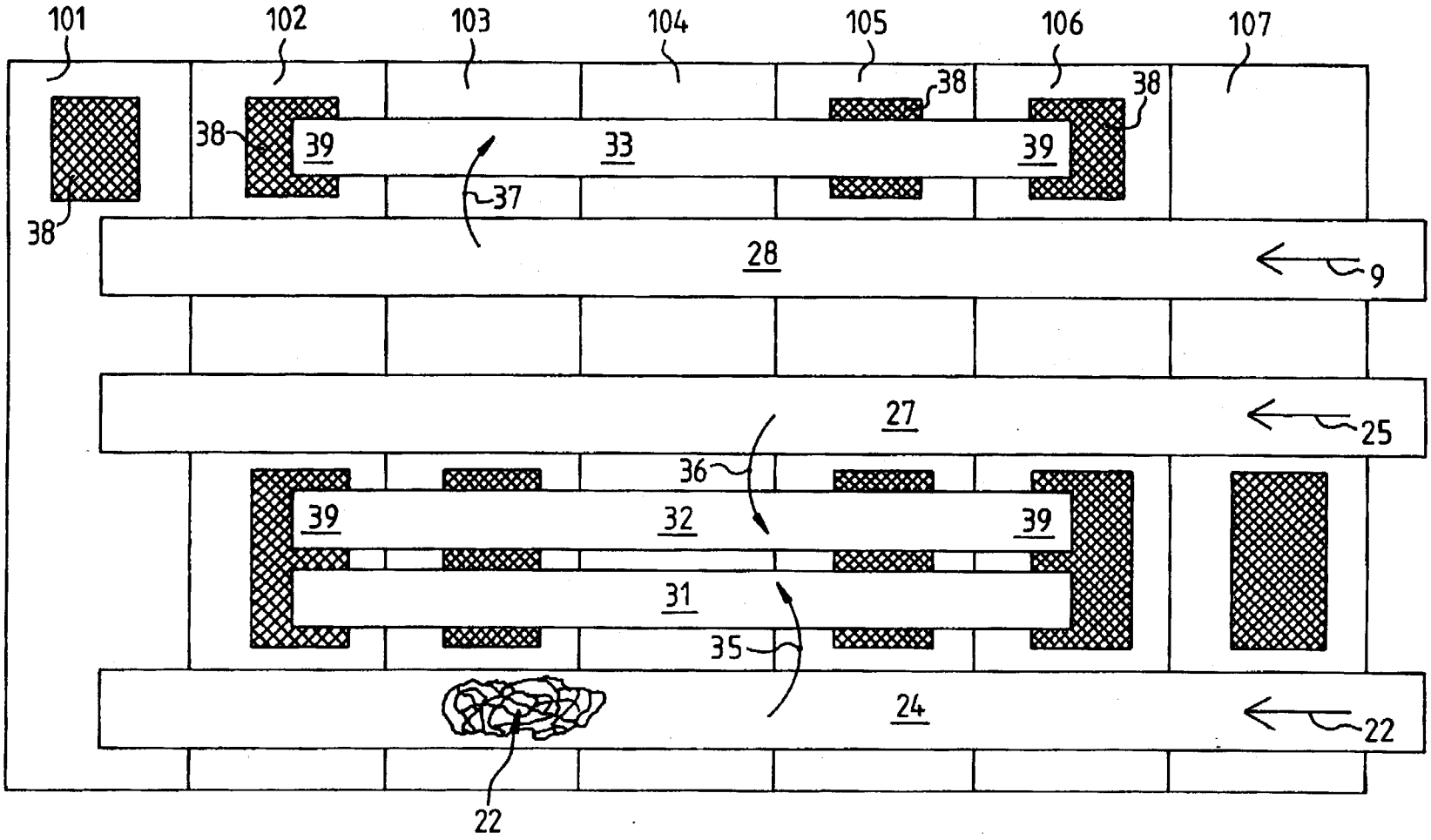
Figure 3B:
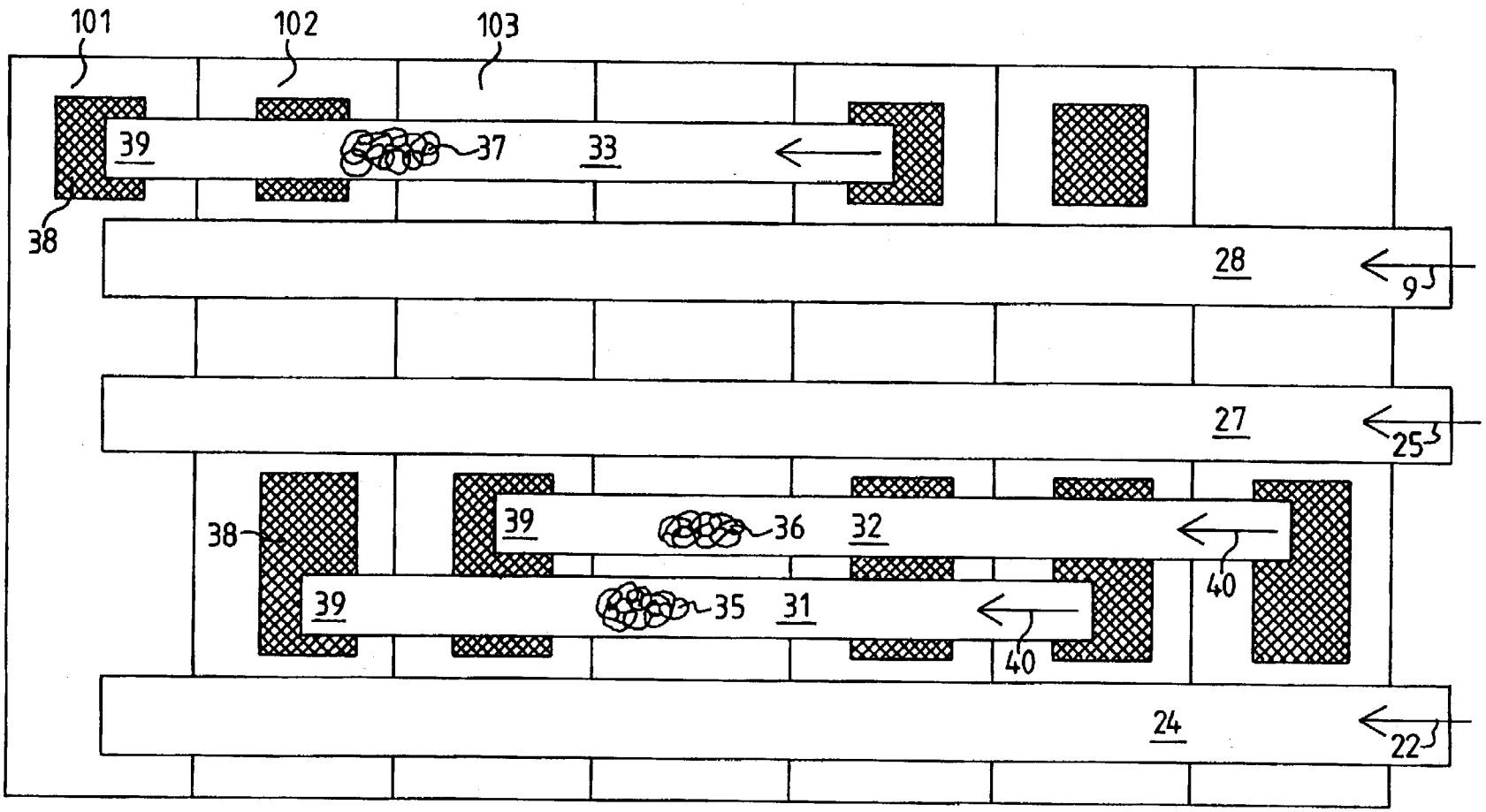

FIG. 2 a plan view of a sorting installation according to the invention, in an overall representation, FIGS. 3*a* and 3*b* show a plan view of three manual selection or sorting belts, connected in parallel, with associated collection devices and useful product bunkers lying below the latter, in various working positions, and FIGS. 4*a*–4*i* show individual representations of the arrangement between sorting belt and collector belt, with a preliminary storage or interim storage device, which may or may not be present, lying between them.

DETAILED DESCRIPTION OF THE INVENTION

The illustrative embodiment which follows is described with reference to a sorting operation for a useful product mixture such as can be used, for example, in the "Dual System" to dispose of packaging material bearing the "Green Dot". The packaging occurring here my consist of glass, tin plate, aluminum, board/cardboard, paper, plastic, laminates or the like.

FIG. 1 shows a lateral view and FIG. 2 a plan view of the sorting installation 1 with various sorting sections. The bags which are delivered containing the mixture of useful packaging product are introduced into a bunker conveyor 2 which is only shown diagrammatically, and fed to a bag opening system 3. In the bag opening system 3, the bags are opened and completely emptied. The loose useful product material is transported onwards by a conveyor belt 4. This conveyor belt thins out the material, and the ferrous materials are lifted out from the flow of material by an FE separator 5. The material mixture, freed of ferrous materials, is then placed on a downstream screening machine 6 and divided into three part-streams, these being a residual fraction 7, a middle fraction 8 and an overflow fraction 9. These useful product streams are shown by corresponding arrows in FIG. 2. The fundamental structure of the screening machine 6 is described in the applicant's EP 0 168 495 B1. Reference is hereby expressly made to this printed publication.

The residual fraction 7 can be withdrawn from the material mixture in the first region of the screening machine 6. It passes over the conveyor belt 10 to a residue bunker 11.

The middle fraction 8 is discharged onto the conveyor belt 12 via the screening machine 6. Similarly, the overflow fraction 9 is discharged onto the conveyor belt 13.

The conveyor belt 12 passes the middle fraction 8 onto a downstream inclined sorting machine 14. The structural form of such an inclined sorting machine 14 is described in the applicant's EP 0 123 825. Reference is also hereby expressly made to this printed publication.

The material mixture 8 passed onto the inclined sorting machine 14 is separated, because of the structural form of the inclined sorting machine 14, into "flat" and "rolling" constituents. The "flat" mixed fraction 15 is transported via a conveyor belt 16 to aluminum-containing separator 17. Aluminum-containing materials are separated out here and re-sorted on the downstream conveyor belt 18. One drop shaft 19 receives aluminum and another drop shaft 20 receives additional aluminum laminates. The residue passes via a drop shaft 21 to a further residue bunker.

The flat mixed fraction 15 treated by the separator 17 passes as a flat mixed fraction 22 onto a conveyor belt 23 which leads to a first manual sorting section or first sorting belt 24.

The "rolling" fraction 25 from the inclined sorting machine 14 is transported via a conveyor belt 26 to a second manual sorting section or sorting conveyor belt 27.

The overflow fraction 9 of the screening machine 6 passes via the conveyor belt 13 to a third manual sorting section or third sorting conveyor belt 28.

In FIGS. 3*a* and 3*b*, the sorting section of the sorting installation with these three manual sorting sections 24, 27, 28 is again shown diagrammatically and enlarged. Beside these three manual selection sections or manual selection conveyor belts 24, 27, 28 there stand, depending on the length of this section, a large number of operatives who undertake manual sorting of the incoming mixed fractions 22, 25, 9. This is further described below.

For all manual sorting sections 24, 27, 28, the possibility fundamentally exists of dropping the material to be sorted out directly, via variable drop shafts, into boxes lying below. Such a drop shaft 29, which is optionally present, can for example be arranged at any desired point of any manual sorting section 24, 27, 28 and be connected to a conveyor belt 30 lying below the latter. This is diagrammatically shown in FIG. 2.

Figure 4A:
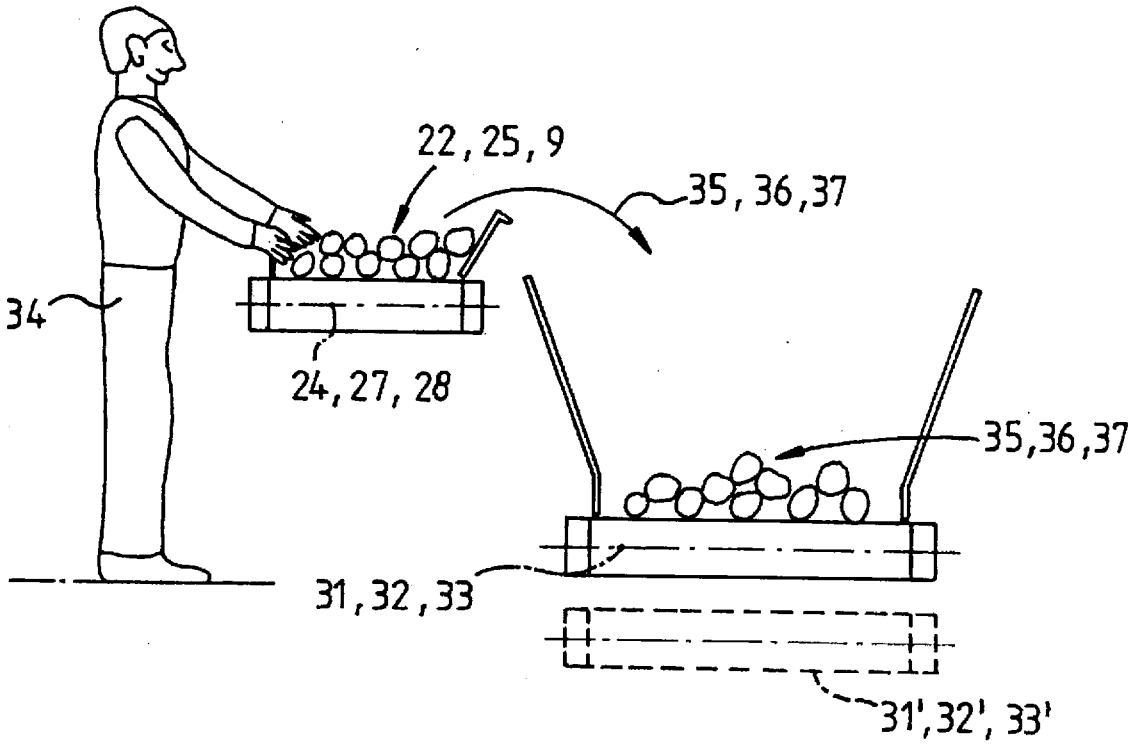

The essential sorting task, however, is performed by means of the collector conveyor belts 31 to 33, assigned to each of the manual sorting sections 24, 27, 28 and lying next to the respective manual sorting sections. These belts 31 to 33 may also, for reasons of space, lie below the sorting belts 24, 27, 28, in which case suitable baffle plates are to be provided. These collector conveyor belts 31 to 33 serve to receive a very specific individual fraction, which is sorted out by the operatives from the respective manual sorting section during a particular working cycle. The starting position for such sorting is shown in FIG. 3*a*. For example, five to ten people stand by the sorting belt or the manual sorting section 24 and sort out, from the flat mixed fraction 22 arriving from the conveyor belt 23, the packaging material consisting of flat board or cardboard, throwing this onto the collector conveyor belt 31. This operation is also shown in FIG. 4*a*, taking the example of a single user 34. In this case, it is to be noted that a large number of users 34 undertake the same working operation, that is to say they remove, in the respective working cycle, only a single fraction from the mixed fraction 22 during a working cycle, for example flat cardboard or board as a monofraction 35. Consequently, there is exclusively a single monofraction 35 to be found on the nearby collector conveyor belt 31. In this arrangement, this working process is carried out batchwise, that is to say that the manual sorting section 24 and the collector belt 31 are stationary during the given working cycle.

Similarly, for example, 5 to 10 operatives 34 stand by the second manual sorting section 27, select a single monofraction 36, for example plastic cups (yoghurt cups), from the rolling mixed fraction 25 arriving from the conveyor belt 26, and throw this monofraction onto the assigned collector conveyor belt 32. Finally, another 5 to 10 operatives 34 likewise stand by the third manual sorting section 28, select, from the stationary sorting belt 28, a further monofraction 37 from the overflow fraction 9 coming from the conveyor belt 13 and throw it onto the stationary collector conveyor belt 33. This monofraction 37 can, for example, relate to mixed plastics.

The length of the working cycle of these individual sorting operations at the three manual sorting sections 24, 27, 28 is designed to be sufficiently long for it to be possible, substantially, to remove from the respective sorting belt all the monofractions which are to be sorted out. This means that the consecutive working cycles can also be of varying lengths, in order thus to be correctly adapted to the respective monofractions to be sorted in terms of the volume thereof that occurs. The current working cycle can be displayed for the operating personnel on an optical display.

Below the manual sorting sections 24, 27, 28, there are, according to the illustrative embodiment, seven bunkers which are designated in the illustrative embodiment 101 to 107. In this arrangement, the bunker 101 contains mixed plastics, the bunker 102 board/cardboard, the bunker 103 cups, the bunker 104 foils, the bunker 105 beverage cartons, the bunker 106 foams and the bunker 107 aluminum and Al laminates. A drop shaft 38 is assigned to each individual bunker, as shown in FIGS. 3*a* and 3*b*.

The dropping operation into these drop shafts 38, forming part of the sorting-out described above, is shown in FIG. 3*b*. For this purpose, the collector conveyor belts 31 to 33 are displaceable in both directions in their axial longitudinal direction and can be reversed in their conveying direction.

For example, the collector conveyor belt 31 must—if necessary—be moved, with the monofraction 35 (board/cardboard) placed on it, with its drop region 39 to the drop shaft 38 of the associated bunker 102 and provided with a correspondingly leftward oriented conveyor belt drive 40. As shown in FIG. 3*b*, the monofraction 35 then falls into the drop shaft 38 of the bunker 102 intended for board/cardboard.

Similarly, the monofraction 36, for example cups, placed on the collector conveyor belt 32 is introduced by a longitudinal displacement of the collector conveyor belt 32 into the bunker 103. As can be seen from FIG. 3*b*, the collector conveyor belt 32 has shifted to the right for this purpose, so that the drop region 39 comes to rest above the collection bunker 103 for this monofraction.

Finally, the monofraction 37 (eg. mixed plastics) discharged from the mixed fraction 9 is also introduced by the collector conveyor belt 33 into the bunker 101, the collector conveyor belt 33 adopting the left-hand end position shown in FIG. 3*b* in order to position the drop region 39 above the drop shaft 38 of the bunker 101.

The same operation takes place on each occasion with the further individual fractions or monofractions to be sorted out, which are to be introduced into the remaining bunkers 104 to 107. In this process, however, according to the illustration in FIG. 2, the middle bunker 104, for example for receiving foils, can be filled by charging it via the drop shafts 29, a conveyor belt 30 being able to transport this fraction away separately.

During the sorting-out of the monofractions from the manual sorting belts 24, 27, 28, these belts are customarily stationary. However, a customary advance may also take place.

An alternative application, according to the illustration in FIG. 2, provides for the sorting belts 24, 27, 28 to have a separation point 41 in the region of the last collection bunker 101, in order to permit the dropping of the residual fraction from these sorting belts 24, 27, 28 into, for example, the bunker 101. This is shown in FIG. 2 for the sorting belts 24, 27 with an aperture at the separation point 41, so that the residual mixture remaining on these belts falls into the bunker 101. The upper third sorting section 28 shown in FIG. 2 has a closed separation point 41, so that the residual fraction remaining on this belt is guided to a downstream conveyor belt 42. Naturally, the separation points 41 of the sorting sections 24, 27 can also be closed, so that the belt section which follows likewise runs out on the conveyor belt 42 or other belts.

The collection bunkers 101 to 107 have a width and height which make it possible for a motor vehicle to be driven into these bunkers and to push the respectively collected monoproduct onto a downstream conveyor belt 43. The respective monofraction is passed by this conveyor belt 43 to a baling press which is not shown in detail.

A working cycle on the respective manual sorting sections 24, 27, 28 comprises picking up a monofraction and dropping it onto a collector conveyor belt 31 to 33 connected in parallel. This collector conveyor belt then has to be emptied during this working stroke, one of the two ends being moved with its drop region above the respectively assigned bunker. When this position is reached, the conveyor belt drive 40 must be switched on and the entire collector conveyor belt emptied. During this period, no new fraction can be brought from the respective manual sorting sections onto the respective collector conveyor belts. Therefore, provision is made, according to the illustrations in FIGS. 4*b* to 4*i*, for a preliminary storage unit 46 to ensure that this period for the emptying of the collector conveyor belts 31 to 33 does not pass unutilized.

The initial position of the sorting operation is shown in FIG. 4*a*. This corresponds to the mode of operation described earlier.

Figure 4B:
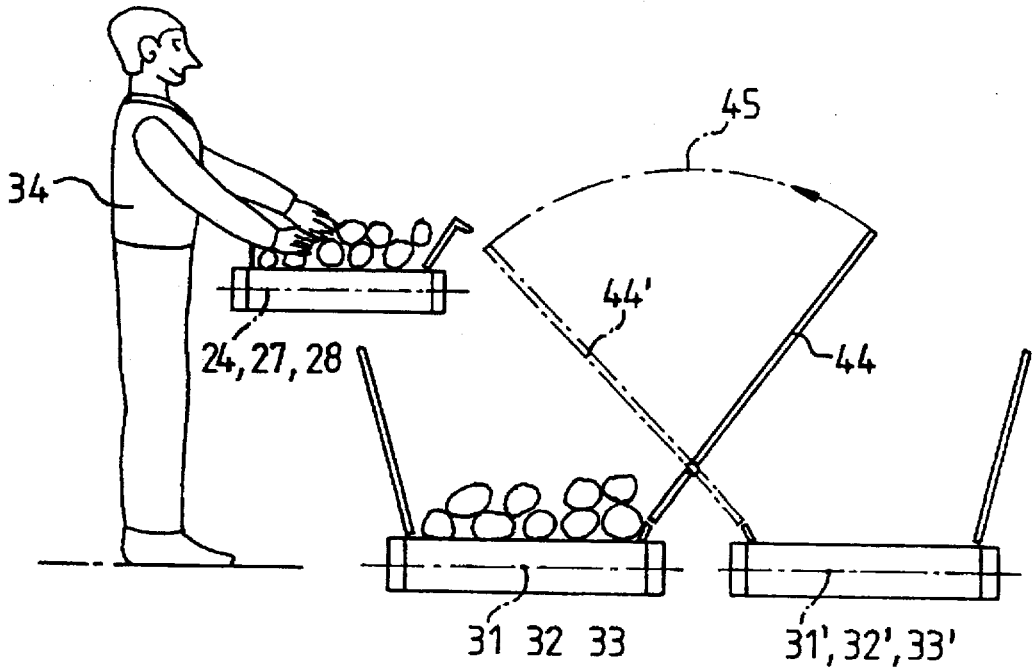

In FIG. 4*b*, the collector conveyor belt 31 to 33 is associated with a collector conveyor belt 31' to 33', arranged parallel to it, in a manner such that the operative 34 can in each case charge one of the collector conveyor belts with a monofraction while the other collector conveyor belt is being emptied into the respective bunker. In order to reach the respectively empty collector conveyor belt, the embodiment according to FIG. 4*b* has a deflector flap 44, which extends over the entire length of the collector conveyor belts and can be turned over into two positions. In the position shown in FIG. 4*b*, the deflector flap 44 is shown in the right-hand position, so that the left-hand collector conveyor belt 31 to 33 can be charged with the monofraction. When this sorting-out operation is concluded, the deflector flap can be swung over into the position 44' (arrow 45), so that the parallel collector conveyor belt 31' to 33' can already be charged with the next monofraction in sequence while the left-hand collector conveyor belt is being emptied into the respectively assigned bunker. As a result, no idle times arise for the operatives.

The two collector conveyor belts can also be arranged one above the other as indicated in FIG. 4*a*, the upper belt 31, 32, 33 being stationary and the lower belt 31', 32', 33' being longitudinally displaceable. As a result, the upper belt 31, 32, 33 can be emptied onto the lower belt 31', 32', 33'. This saves the time taken by the lower belt 31', 32', 33' to move to the associated bunker.

Figure 4C:
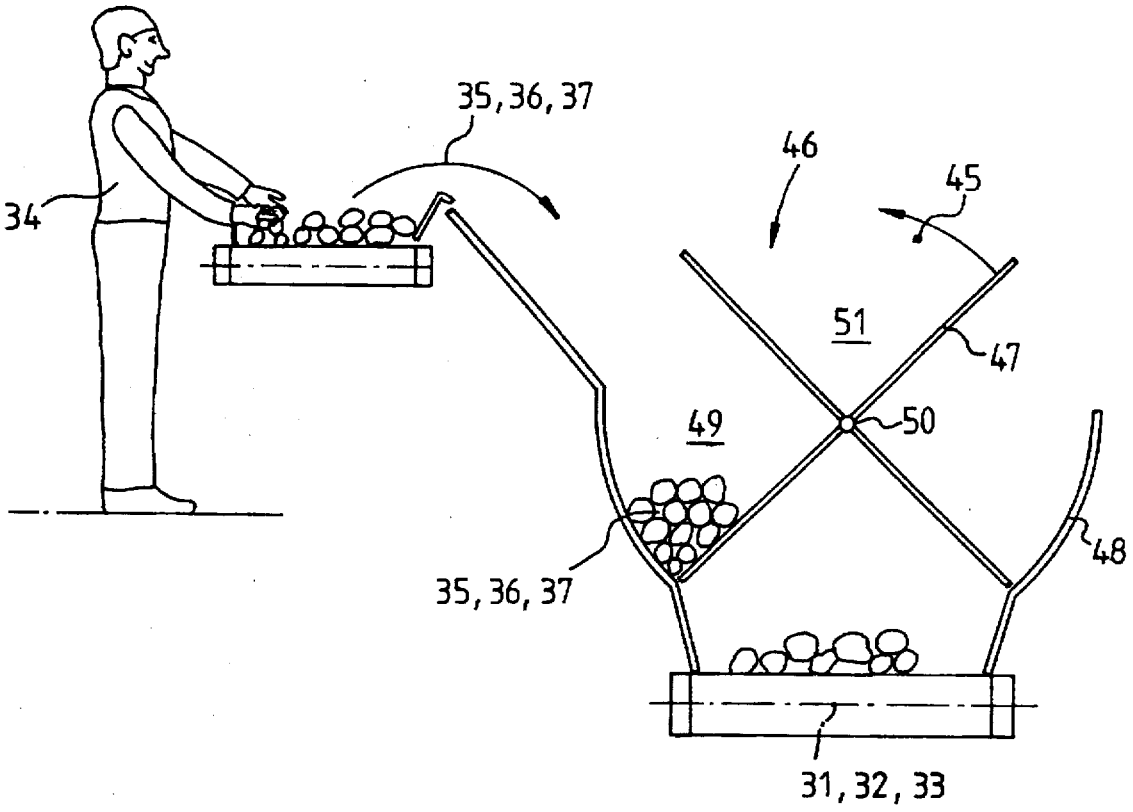

According to the illustration in FIG. 4*c*, only one collector conveyor belt 31 to 33 is again present. In this case, the monofraction 35 to 37 is introduced into a preliminary storage unit 46, which is designed as a star conveyor 47 in a corresponding housing 48, according to the illustrative embodiment in FIG. 4*c*. The monofraction 35 to 37 sorted into a chamber 49 of the star conveyor 47 is held in this position at least until the collector conveyor belt 31 to 33 is emptied of the preceding monofraction and is returned into the working position. The preliminary storage unit 46 in FIG. 4*c* is designed similarly to a bucket-wheel sluice with a horizontal axis of rotation 50, it being possible for the individual chambers to be charged with the respective monofraction. For example, the operative 34 can, optionally, also charge a second chamber (upper chamber 51) with another fraction if this is necessary.

Figure 4D:
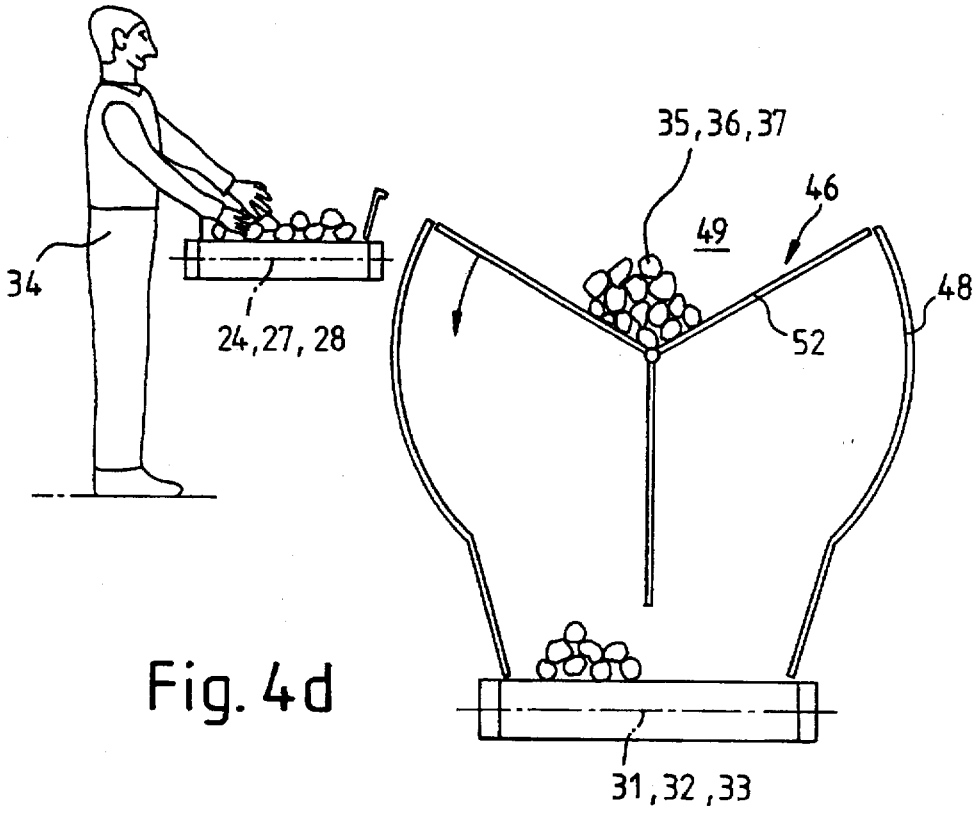
Figure 4E:
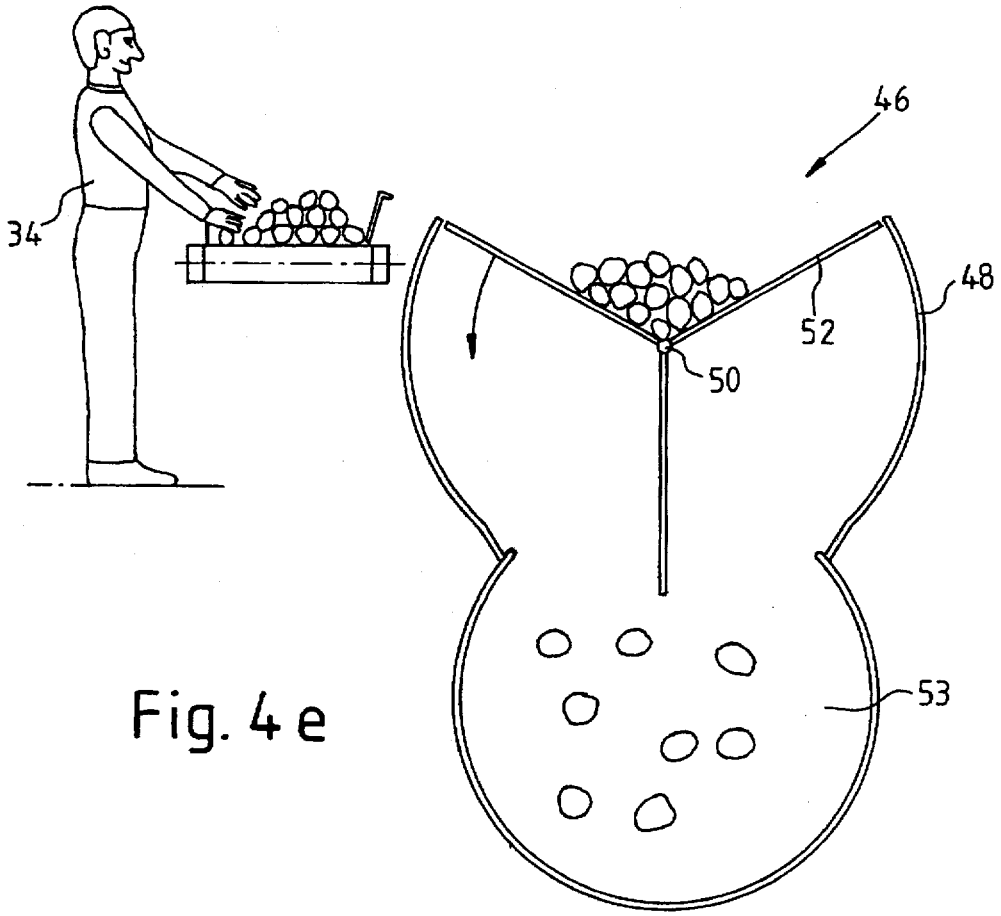

FIGS. 4*d*, 4*e* likewise show a preliminary storage unit 46 in the form of a three-vane star conveyor 52, which is fixed in a housing 48 resembling a bucket-wheel sluice. In this arrangement, the star conveyor 52 is arranged in a Y shape in the charging position, with an upper V-shaped charging chamber 49 for the monofraction 35 to 37. When the lower collector conveyor belt 31 to 33 (FIG. 4*d*) is emptied, the star conveyor can already be brought slowly into a dropping position for the loaded monofraction.

In FIG. 4*e*, a pneumatic line 53 is provided instead of the collector conveyor belt 31 to 33, and passes the monofraction introduced into the line to the associated bunker 101 to 107. In this case, the preliminary storage unit 46 with the star conveyor 52 serves as bucket-wheel sluice to seal the lower pneumatic line 53, which is subjected to the action of pressure, against the environment.

The star conveyor 52 is therefore sealingly mounted in the bucket-wheel housing 48.

Figure 4F:
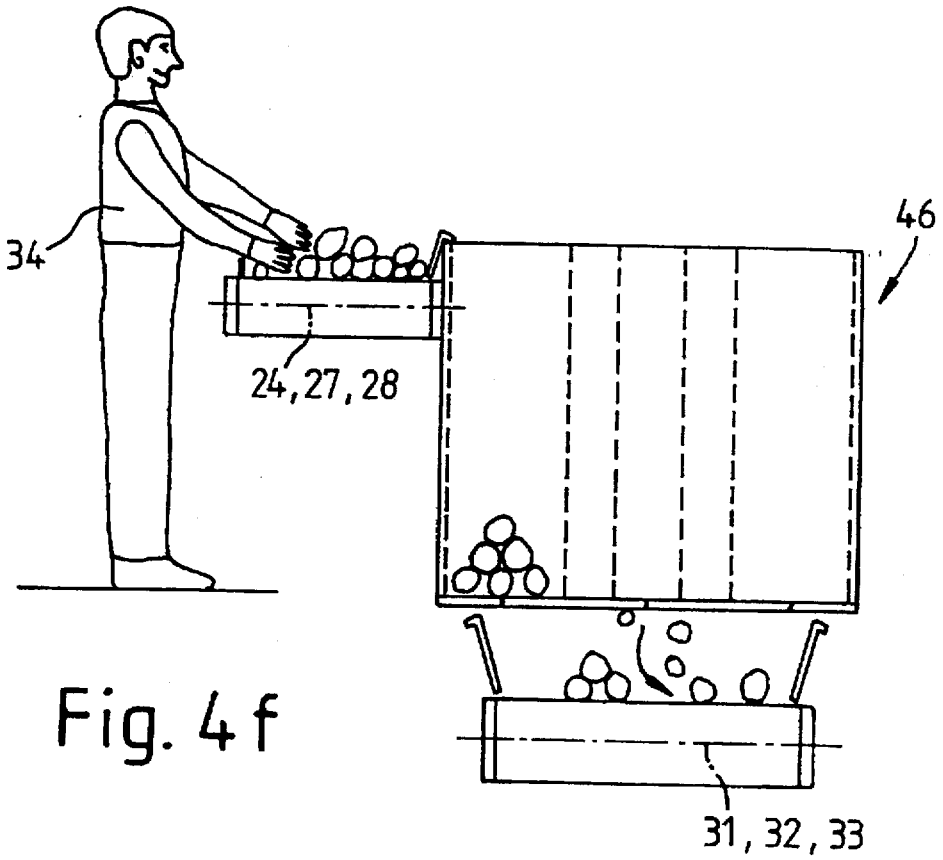
Figure 4G:
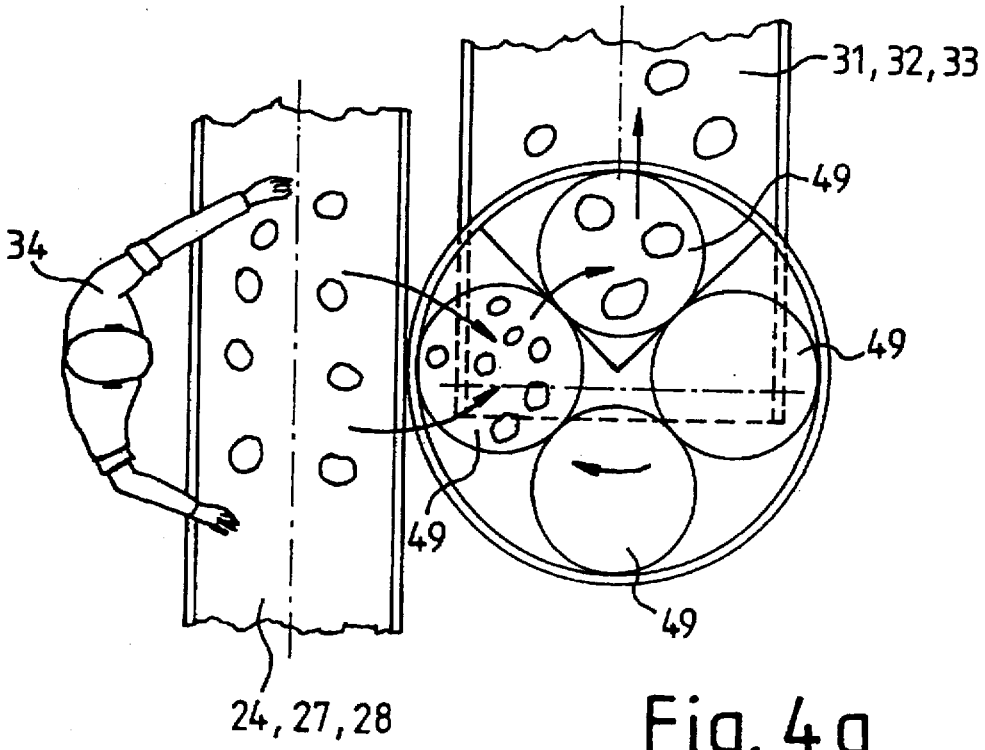

FIGS. 4*f*–4*g* shows a further alternative embodiment of a preliminary storage unit 46. In contrast to the illustration in FIGS. 4*c* to 4*e*, a preliminary storage unit 46 with a vertical axis of rotation 50 is provided in the illustrative embodiment according to 4*f* and 4*g*, four individual chambers 49, for example, being provided according to the lower illustration in FIG. 4*g*, into which the respective monofraction is introduced. In the illustrative embodiment, the individual chambers 49 are of cylindrical design, three chambers being closed at their bottom surfaces and the fourth chamber 49' being open toward the bottom in order to pass the monofraction introduced into the chambers on to the collector conveyor belt 31 to 33.

The preliminary storage unit 46 is, accordingly, designed similarly to a turret with individual drums. It can, however, also be designed similarly to a bucket-wheel sluice with V-shaped individual chambers, only one chamber in each case being open toward the bottom and the collector conveyor belt. Instead of the collector conveyor belt 31 to 33, the embodiment according to FIG. 4*f*–4*g* can, of course, also have a pneumatic line as is shown in FIG. 4*e*.

The illustrations of the embodiment according to FIGS. 4*h*–4*i* initially corresponds to the embodiment according to FIG. 4*a*, with a manual sorting section 24, 27, 28, designed as a conveyor belt, from which the operative 34 processes, for example, a mixed fraction 15, 22, 25 and sorts out from it, in each case, a monofraction 35, 36, 37 onto the collector conveyor belt 31, 32, 33 situated below. This "normal" case is described in FIG. 4*a*.

In practice, it has proven that the mixed fraction 15, 22, 25, etc., is obtained on the manual sorting section 24, 27, 28 in widely varying amounts. For example, so-called hollow bodies and cups occur in much higher proportions than is the case for, for example, beverage cartons, aluminum and other products.

Figure 4H:
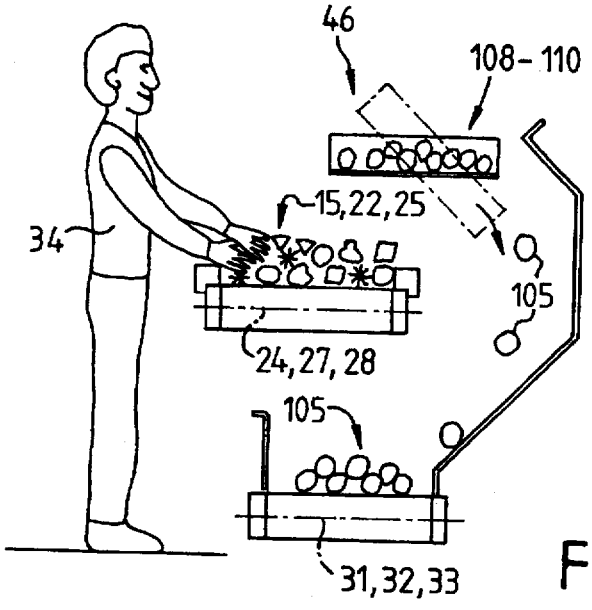
Figure 4I:
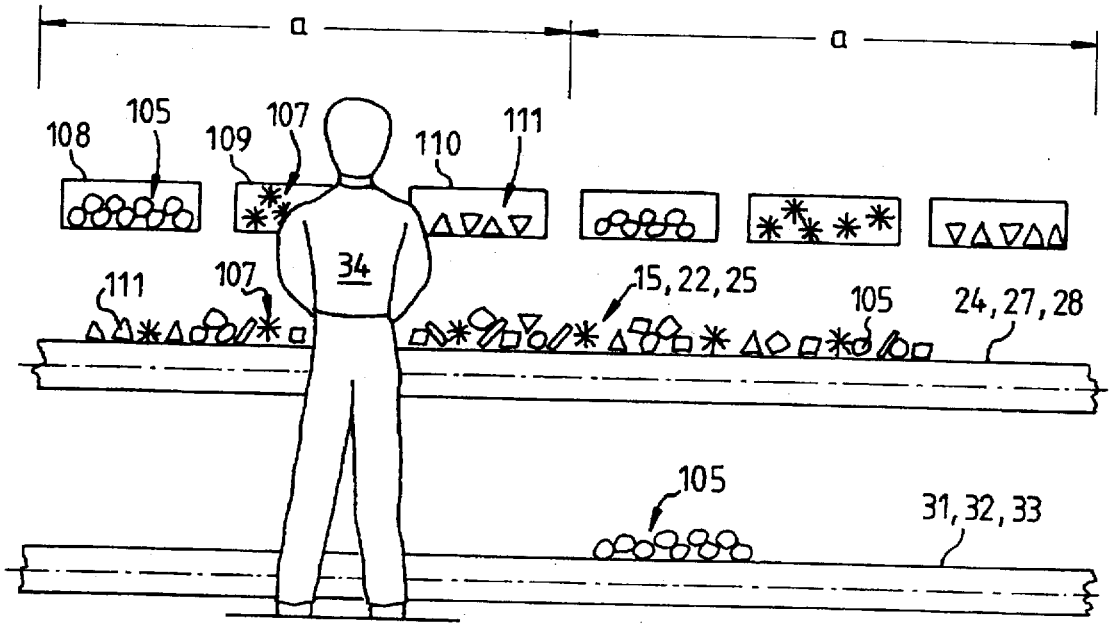

The embodiment according to FIGS. 4*h* and 4*i*, then, envisages that each operative 34 is assigned a number "n" of buffer boxes 108 to 110 or storage boxes in the immediate area of operation, of length "a", into which monofractions occurring to a lesser extent or in lesser quantity are sorted for interim storage. As can be seen from FIGS. 4*h* and 4*i* upper picture and lower picture, three buffer boxes 108 to 110 lie, for example, immediately in front of the operative 34 and somewhat above the manual sorting section 24, 27, 28, so that the operative can very easily place an individual fraction into one of these buffer boxes. For example, the buffer box 108 takes beverage cartons 105, the buffer box 109 aluminum products 107, and the buffer box 110 other residues 111. The installation according to the invention can, then, be controlled so that the collector conveyor belt 31 to 33 is charged, consecutively over time, with a respective monofraction which occurs in relatively large quantities on the manual sorting section. For example, initially only hollow-body fractions are thrown onto the collector conveyor belt 31 to 33, and these are cleared off the collector conveyor belt after a certain processing time. During this clearance period or belt emptying period of the collector conveyor belt 31 to 33, the operative 34 can easily place one or more of the monofractions 105, 107, 111 which occur to a lesser extent into the individual buffer boxes 108 to 110 and, in this manner, make profitable use of the emptying period of the collector conveyor belt. After this operation, for example, the second monofraction which occurs to a large extent, for example cups, can likewise be placed on the collector conveyor belt 31 to 33, and the subsequent emptying period of the collector conveyor belt is again used to charge the buffer boxes 108 to 110. This sorting operation of the buffer boxes, too, can, in each period of time, take place always into one of the boxes only, or simultaneously into a plurality of boxes. The operative can, consequently, charge only the buffer box 108 with the fraction 105 (for example, beverage cartons) in the belt emptying interval.

In FIG. 4*h*, the emptying, for example, of the tilted buffer box 108 is shown in broken lines, the fraction 105 being tipped laterally out of this buffer box and falling onto the collector belt 31 to 33. During this phase and the belt emptying phase, the operative 34 can of course charge one of the other two buffer boxes 109, 110 with the monofraction 107, 111. The buffer boxes 108 to 110 can, consequently, be emptied in a particular working rhythm. Only after a plurality of cycles of monofractions occurring to a large extent have been processed and disposed of can one individual buffer box in each case, which has now become full, be tilted for interim disposal and conveyed onto the conveyor belt 31 to 33. As a result of this measure, optimum utilization of the emptying periods of the collector conveyor belts 31 to 33 is possible.

The invention is not restricted to the illustrative embodiment which has been illustrated and described, but also encompasses all technical further developments within the scope of the concept of the invention. In particular, a further advantage of the installation according to the invention lies in the fact that the air conditioning and thermal economy can be decisively improved. As a result of the fact that only a few sorting cabin apertures are necessary, because of the inward and outward movement of the various material flows, the quantities of air required for dust removal, disinfection and air conditioning can be significantly reduced as compared with conventional solutions using the drop shaft. The air/volume ratio corresponds to the ratio of the free apertures.

With thermal outputs of, for example, 13.6 $Wh/m^3$ of incoming air and a temperature difference of 38 degrees (−20 degrees outside temperature to +18 degrees sorting cabin temperature), the reduction in the volume of air is related in a linear manner both to the reduction of thermal output and to the reduction of the air output.

A further advantage of the installation lies in the fact that the latter can be adapted to virtually any desired sorting task by means of an appropriate control unit. The sorting cycles for each conveyor belt, and hence for each fraction, can be influenced by a "belt foreman" posted at the start of the conveyor belt, using a foot or knee switch.

The total cycle time, in other words the programmed idle time for the sorting-out of 1, 2 or more fractions, can be set or influenced by the machine minder.

For new control systems, provision is made for the basic functions for the operation of the installation to be set to a plurality of typical packaging mixtures via a keyboard or similar operating elements. In this case, the installation can also be switched over to continuous operation.

In a further embodiment of the invention, it is also possible for a longitudinal division of the sorting belt 24, 27, 28 to be provided. In this case, provision is made for the sorting belt to be divided longitudinally into 2 or more chambers by an undulating edge or the like, for the purpose of interim storage and, if appropriate, onward transportation of low-volume fractions, for which it is not worthwhile to switch over the collector belts and the distributor chutes.

We claim:

1. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device comprising a mechanical collection conveyor belt which leads to various ones of said useful product bins.

2. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device comprising a collection displacement belt displaceable in a longitudinal direction so that an end of said belt is positioned over a specific designated bin, and so that a respective monofraction of the variety of useful products can be delivered to the specific designated bin from said belt.

3. An installation for sorting useful products, comprising:

at least one sorting section for supplying a variety of useful products for sorting therefrom a plurality of specific useful product monofractions;

five to ten useful product bins arranged side-by-side, each bin being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device comprising a collection conveyor belt arranged above the bins, said belt being selectively displaceable in opposite longitudinal directions so that a selected one of two ends of said belt is positioned over a specific designated bin for delivering a monofraction of the variety of useful products thereto.

4. An installation for sorting useful products, comprising:

at least one sorting section for supplying a variety of useful products for sorting therefrom a plurality of specific useful product monofractions, said sorting section comprising a plurality of sorting belts;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device comprising a plurality of parallel-arranged collection conveyor belts, each of said sorting belts being associated with a plurality of said conveyor belts.

5. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and a plurality of collection devices, each being positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products; and control means operatively connected with said collection devices for controlling the actuation of said collection devices as a function of each other.

6. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device comprising a first collection device and a second collection device for receiving an additional specific useful product monofraction during the second operating cycle of said first collection device.

7. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device further comprising an interim storage device located adjacent to said collection device for receiving and storing an additional specific useful product monofraction during the second operating cycle of said collection device.

8. An installation for sorting useful products, comprising:

at least one sorting section for supplying a variety of useful products for sorting therefrom a plurality of specific useful product monofractions;

a plurality of useful product bins, each being designated to receive a specific useful product monofraction from the variety of useful products; and at least one collection device positioned parallel to said sorting section for receiving the specific useful product monofraction and conveying the specific useful product monofraction from said sorting section to a designated useful product bin, said collection device being still during a first operating cycle so that the specific useful product monofraction can be received by said collection device, and being operatable during a second, successive operating cycle in which said collection device empties the specific useful product monofraction thereon into the designated useful product bin; said first and second operating cycles being repeatable for sorting at least an additional different specific useful product monofraction from the variety of useful products, said collection device moving the specific useful product monotracting during the second operating cycle; and at least one preliminary storage device associated with at least one of said sorting section and said collection device, for receiving at least one additional monofraction of the variety of useful products during the movement of the specific useful product monofraction and emptying of said collection device.

9. The installation according to claim 8, wherein said collection device comprises two parallel running collection conveyor belts, said preliminary storage device including a deflector flap directing the monofraction to a selected one of the two conveyor belts.

10. The installation according to claim 8, wherein said collection device comprises a collection conveyor belt, and said preliminary storage device comprises a star conveyor having a collection chamber for receiving the additional monofraction, said star conveyor being pivotable so that the monofraction contained within said collection chamber falls onto the collection conveyor belt.

11. The installation according to claim 8, wherein said collection device comprises one of a mechanical conveying belt and a pneumatic conveying device, said preliminary storage device comprising a bucket wheel rotatable about a horizontal rotational axis, said bucket wheel having chambers for receiving the additional monofraction, whereby rotation of said bucket wheel causes the monofraction contained within said chambers to be delivered to said collection device.

12. The installation according to claim 8, wherein said preliminary storage device comprises one of a stationary bucket wheel and a drum magazine rotatable about a vertical axis, and including a plurality of chambers for receiving the additional monofraction, wherein only one chamber is open toward the bottom for intermittent emptying.

13. The installation according to claim 8, wherein said preliminary storage device comprises a plurality of buffer boxes associated directly with said sorting section and each receiving one respective additional monofraction.

14. The installation according to claim 13, wherein each buffer box is emptied onto said collection device only after several first and second operating cycles have been completed for other monofractions.

15. The installation according to claim 13, wherein said buffer boxes only receive monofractions which occur in small quantities relative to the variety of useful products.

* * * * *